US009526135B2

(12) United States Patent
Lopez et al.

(10) Patent No.: US 9,526,135 B2
(45) Date of Patent: Dec. 20, 2016

(54) DRIVER DEVICE AND DRIVING METHOD FOR DRIVING A LOAD, IN PARTICULAR AN LED UNIT

(75) Inventors: Toni Lopez, Eindhoven (BE); Reinhold Elferich, Eindhoven (DE)

(73) Assignee: Philips Lighting Holding B.V., Eindhoven (NL)

( * ) Notice: Subject to any disclaimer, the term of this patent is extended or adjusted under 35 U.S.C. 154(b) by 248 days.

(21) Appl. No.: 13/882,619

(22) PCT Filed: Oct. 31, 2011

(86) PCT No.: PCT/IB2011/054825
§ 371 (c)(1),
(2), (4) Date: Apr. 30, 2013

(87) PCT Pub. No.: WO2012/059853
PCT Pub. Date: May 10, 2012

(65) Prior Publication Data

US 2013/0221865 A1 Aug. 29, 2013

(30) Foreign Application Priority Data

Nov. 3, 2010 (EP) ..... 10189759

(51) Int. Cl.
*H05B 33/08* (2006.01)

(52) U.S. Cl.
CPC ..... *H05B 33/0815* (2013.01)

(58) Field of Classification Search
CPC .... B23K 11/248; H02M 1/02; H05B 33/0815; H05B 37/029
(Continued)

(56) References Cited

U.S. PATENT DOCUMENTS 5,315,214 A 5/1994 Lesea
5,828,562 A 10/1998 Rivet
(Continued)

FOREIGN PATENT DOCUMENTS

JP 05056665 A 3/1993
JP 2010079377 A 4/2010
WO WO2010027254 A1 3/2010

OTHER PUBLICATIONS

Application Note 42030; "Theory and Application of the ML4821 Average Current Mode PFC Controller", Fairchild Semiconductor, Oct. 25, 1997 (Oct. 25, 1997), pp. 1-19, XP55021321,USA Retrieved from the Internet: URL:http://server.elektro.dtu.dk/ftp/database/Data_CDs/Component_data/Fairchild_2002/Analog/PDFs/Application_Notes/General/ApplicationNotesBrief_Bullet/AN-42030.pdf, [retrieved on Mar. 8, 2012] p. 8-p. 17; figures 10-22.
(Continued)

*Primary Examiner* — John Poos
*Assistant Examiner* — David Mattison

(57) ABSTRACT

The present invention relates to a driver device (50*a*-50*e*) and a corresponding driving method for driving a load (22), in particular an LED unit comprising a power input unit (52) for receiving an input voltage (V20) from an external power supply and for providing a rectified supply voltage (V52), a power conversion unit (54) for converting said supply voltage (V52) to a load current (154) for powering the load (22), a charge capacitor (56) for storing a charge and powering the load (22) when insufficient energy for powering the load (22) and/or the power conversion unit (54) is drawn from said external power supply (20) at a given time, and a control unit (58) for controlling the charging of said charge capacitor (56) by said supply voltage (V52) to a capacitor voltage (V56) that can be substantially higher than
(Continued)

the peak voltage (V52) of said supply voltage and for powering the load (22).

18 Claims, 5 Drawing Sheets

(58) Field of Classification Search
USPC ..... 315/201
See application file for complete search history.

(56) References Cited

U.S. PATENT DOCUMENTS

| | | | | |
|---|---|---|---|---|
| 6,212,082 | B1 | 4/2001 | Bailly | |
| 2001/0028227 | A1* | 10/2001 | Lys | A61N 5/0616 315/317 |
| 2002/0118553 | A1 | 8/2002 | Morita | |
| 2005/0030772 | A1 | 2/2005 | Phadke | |
| 2005/0218838 | A1* | 10/2005 | Lys | F21S 48/325 315/291 |
| 2010/0045102 | A1* | 2/2010 | Kitanaka | H02M 3/1582 307/9.1 |
| 2010/0110730 | A1 | 5/2010 | Ger | |
| 2010/0332896 | A1* | 12/2010 | Wilson | G06F 1/30 714/14 |

OTHER PUBLICATIONS

Robert Erickson et al., "Design of a Simple High-Power-Factor Rectifier Bsed on the Flyback Converter", IEEE Proceedings of the Applied Power Electronics 25 Conferences and Expositions, 1990, pp. 792-801.

* cited by examiner

DRIVER DEVICE AND DRIVING METHOD FOR DRIVING A LOAD, IN PARTICULAR AN LED UNIT

FIELD OF THE INVENTION

The present invention relates to a driver device and a corresponding driving method for driving a load, in particular an LED unit comprising one or more LEDs. Further, the present invention relates to a light apparatus.

BACKGROUND OF THE INVENTION

In the field of LED drivers for offline applications such as retrofit lamps, solutions are demanded to cope with high efficiency, high power density, long lifetime, high power factor and low cost, among other relevant features. While practically all existing solutions compromise one or the other requirement, it is essential that the proposed driver circuits properly condition the form of the mains energy to the form required by the LEDs, while keeping compliance with present and future power mains regulations. It is of critical importance to guarantee a maximum perceptible light flicker at the same time that the power factor is maintained above a certain limit.

WO 2010/027254 A1 discloses a lighting application comprising an LED assembly comprising a serial connection of two or more LED units, each LED unit comprising one or more LEDs, and each LED unit being provided with a controllable switch for substantially short-circuiting the LED unit. The lighting application further comprises a control unit for controlling a drive unit and arranged to receive a signal representing a voltage level of the supply voltage, and control the switches in accordance with the signal. Further, there is provided an LED driver that enables operating a TRIAC-based dimmer at an optimal holding current and an LED driver comprising a switchable buffer, e.g. a capacitor.

SUMMARY OF THE INVENTION

It is an object of the present invention to provide a driver device and a corresponding driving method for driving a load, in particular an LED unit comprising one or more LEDs, particularly providing a high power factor, small size, high efficiency, long lifetime and low cost. Further, it is an object of the present invention to provide a corresponding light apparatus.

According to an aspect of the present invention, a driver device is provided comprising:

- a power input unit for receiving an input voltage from an external power supply and for providing a rectified supply voltage,
- a power conversion unit for converting said supply voltage to a supply current for powering the load,
- a charge capacitor for storing a charge and powering the load when insufficient energy for powering the load and/or the power conversion unit is drawn from the power supply at a given time, and
- a control unit for controlling the charging of said charge capacitor by said supply voltage to a capacitor voltage that can be substantially higher than the peak voltage of said supply voltage and for powering the load.

According to another aspect of the present invention, a corresponding driving method is provided.

According to still another aspect of the present invention, a light apparatus is provided comprising a light assembly comprising one or more light units, in particular an LED unit comprising one or more LEDs, and a driver device for driving said light assembly as provided according to the present invention.

Preferred embodiments of the invention are defined in the dependent claims. It shall be understood that the claimed method has similar and/or identical preferred embodiments as the claimed device and as defined in the dependent claims.

The present invention is based on the idea to provide a control unit by which, inter alia, the charging of the charge capacitor is controlled, preferably in an active manner. In this way, the charge capacitor can be charged to the desired level in a controlled manner, in particular, controlling the speed, form and/or degree of the charging of that charge capacitor to improve conversion efficiency and power factor. The charging can particularly be controlled such that the charge capacitor is charged to a voltage level that can be substantially higher than the peak voltage of the supply voltage. Further, the powering of the load can be controlled in such a way that the energy stored in the capacitor is provided to the load only when needed to avoid perceptible flicker, in particular when little or no energy is drawn from the power supply to power the load at a given time (e.g. when no or not sufficient energy can be drawn from a mains voltage provided as input to the power input unit). Preferably, the energy stored in the charge capacitor can be most effectively exploited according to the present invention, which provides the advantage that the capacitance of the charge capacitor can be dimensioned much smaller compared to the charge capacitor as used in known driver devices.

The supply voltage generally is a rectified periodic supply voltage provided by a power input unit. In case an AC mains voltage is provided as input voltage to the power input unit, e.g. from a mains voltage supply, a rectifier unit is preferably used in the power input unit for rectifying a provided AC input voltage, e.g. a mains voltage, into the rectified periodic supply voltage. Such a rectifier unit may, for instance, comprise a generally known half-bridge or full-bridge rectifier. The supply voltage thus has the same polarity for either polarity of the AC input voltage.

Alternatively, if e.g. such a rectified periodic supply voltage is already provided at the input of the power input unit, e.g. from a rectifier (representing said external voltage supply) provided elsewhere, the power input unit simply comprises input terminals and, if needed, other elements like e.g. an amplifier.

In an embodiment, said control unit is coupled in series to said charge capacitor, in particular between the charge capacitor and a node between the power input unit and the power conversion unit or between the charge capacitor and the load. These embodiments are simple to implement and provide the desired functions.

In a particularly advantageous embodiment, said control unit is coupled between said charge capacitor and a node between said power input unit and said power conversion unit, said control unit comprising

- a charging control unit coupled to said power supply unit for controlling the charging of said charge capacitor by said supply voltage to a capacitor voltage that can be substantially higher than the peak voltage of said supply voltage,
- a switch coupled in parallel with said charging control unit for switchably connecting said charge capacitor to a node between said power input unit and said power conversion unit for providing the energy stored in said charge capacitor to the power conversion unit and the load, and a switch control unit for controlling said switch.

When the switch is open, power (preferably low power) is drawn from the power input unit (or, more precisely, any external power source, e.g. a mains power supply coupled to the power input unit) to the charge capacitor for charging it whereas, when the switch is closed, the energy of the charge capacitor is provided to the power conversion unit and, thus, to the load. The charging control unit may preferably be an active circuit like a boost converter. It enables controlling the energy in the charge capacitor in such a way that the power factor of the mains power supply can be high and the capacitance of the charge capacitor can be low.

In an embodiment, the switch control unit is adapted to control said switch to connect said charge capacitor to said power conversion unit for powering said load when the magnitude of the supply voltage (and the mains voltage) drops below a switching threshold and to disconnect said charge capacitor from said power conversion unit when the capacitor voltage drops below said switching threshold. Preferably, said switching threshold corresponds to a voltage slightly higher (e.g. 1-10% higher) than the voltage across the load, preferably in cases where the power conversion unit comprises a step-down converter. However, in other embodiments, a predetermined switching threshold may be used as well for this purpose. Hence, only during relatively short time durations the switch is switched on to connect the charge capacitor to said load (indirectly via the power conversion unit), and during said short time duration a significant part of the energy stored in the charge capacitor may be used for powering the load, i.e. the voltage across the charge capacitor may drop from a high level (higher than the peak voltage of the power supply voltage) to a very low level, in particular the switching threshold and/or the voltage across the load.

In another embodiment, the control unit is connected to the output of the power conversion unit. In this embodiment, the control unit comprises a charging control unit coupled to said output of the power conversion unit for controlling the charging of said charge capacitor by a load voltage across said load to a capacitor voltage that can be substantially higher than the load voltage, a switch for switchably connecting said charge capacitor to a node between said power input unit and said power conversion unit for providing the energy stored in said charge capacitor to the power conversion unit, and a switch control unit for controlling said switch.

In yet another embodiment, the control unit is connected to the output of the power conversion unit, said control unit comprising a bidirectional charging control unit for charging the charge capacitor by a load voltage across said load to a capacitor voltage that can be substantially higher than the load voltage. Preferably, the charging control unit comprises a bidirectional boost converter or a bidirectional buck-boost converter. When, at a given time, insufficient energy is drawn from the power supply, the charging control unit, by virtue of its bidirectional feature, bypasses the stored energy of the charge capacitor directly to the load.

Hence, various embodiments exist for controlling the storage energy of the charge capacitor. It depends on the desired implementation and the desired hardware/software available or to be used which particular embodiment is to be used for providing a particular implementation of the driver device.

As mentioned above, the charging of the charge capacitor can preferably be controlled by the charging control unit. In particular, various parameters of the charging process can be controlled, such as the timing, in particular the start time, stop time and duration. Preferably, the timing is controlled such that the charge capacitor is (actively) charged, generally to a voltage that can be higher than the peak mains voltage, during a charging period where the supply voltage is above a charging threshold. In particular, during the peak times of the supply voltage, the charging is effected, and the charging control unit, e.g. the boost converter, is only working during said short time periods, which contributes to achieving a high driver efficiency. Further, the speed, form and/or degree of the charging of said charge capacitor can preferably be controlled to improve the power factor and/or optimize the charging such that the normal operation of the driver device, in particular the provision of a constant output current to the load, is not negatively affected by said charging of the charge capacitor.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
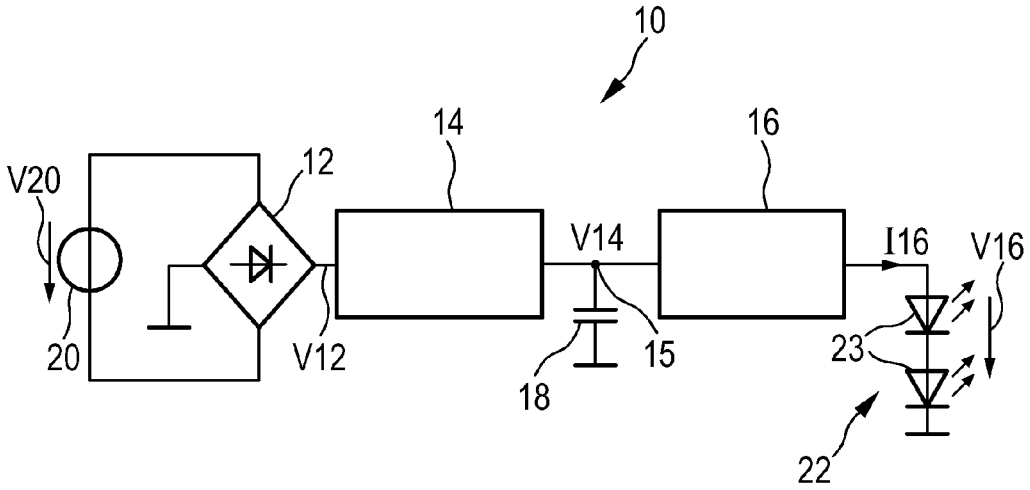
FIG. 1 shows a schematic block diagram of a known two-stage driver device.

An embodiment of a known two-stage driver device 10 is schematically shown in FIG. 1. Said driver device 10 comprises a rectifier unit 12, a first stage preconditioning unit 14 coupled to the output of the rectifier unit 12, a second stage conversion unit 16 coupled to the output of the first stage preconditioning unit 14 and a charge capacitor 18 coupled to the node 15 between said first stage preconditioning unit 14 and said second stage conversion unit 16. The rectifier unit 12 preferably comprises a rectifier, such as a known full-bridge or half-bridge rectifier, for rectifying an AC input voltage V20 provided, e.g., from an external mains voltage supply 20, into a rectified voltage V12. The load 22, in this embodiment an LED unit comprising two LEDs 23, is coupled to the output of the second stage conversion unit 16 whose output signal, in particular its drive voltage V16 and its drive current 116, is used to drive the load 22.

The first stage preconditioning unit 14 preconditions the rectified voltage V12 into an intermediate DC voltage V14, and the second stage conversion unit 16 converts said intermediate DC voltage V14 into the desired DC drive voltage V16. The charge capacitor 18 is provided to store a charge, i.e. is charged from the intermediate DC voltage V14, thereby filtering the low frequency signal of the rectified voltage V12 to ensure a substantially constant output signal of the second stage conversion unit 16, in particular a constant drive current 116 through the load 22. These elements 14, 16, 18 are generally known and widely used in such driver devices 10 and thus shall not be described in more detail here.

Generally, the driver device 10 complies with the aforementioned demand for a high power factor and low flicker at the expense of larger space requirements and cost, which might be drastically limited particularly in retrofit applications. The size of the first stage preconditioning unit 14 may be mainly determined by the associated passive components, particularly if it comprises a switched mode power supply (SMPS), e.g. a boost converter, operating at low or moderate switching frequency. Any attempt to increase the switching frequency so as to reduce the size of these filter components may yield a rapid increase in energy losses in the hard-switched SMPS and hence result in the need to use larger heat sinks.

Figure 2A:
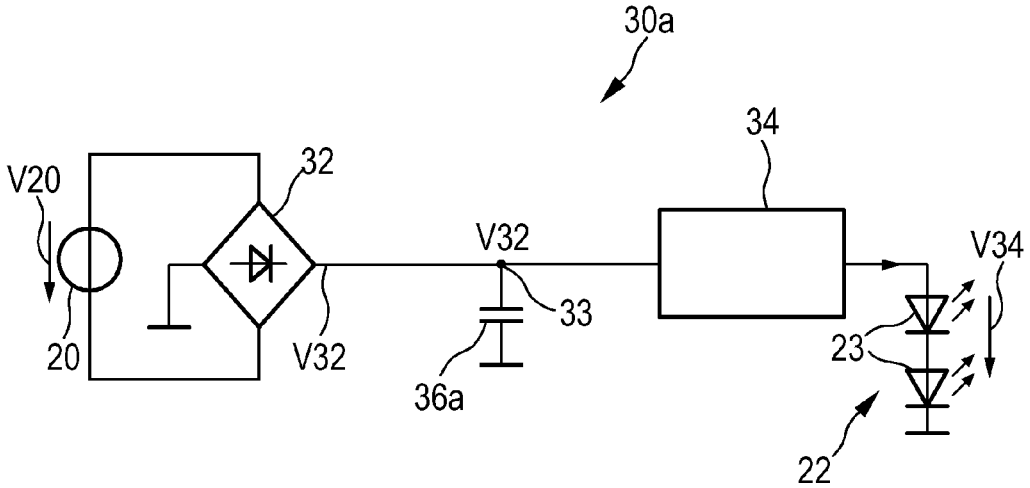
FIG. 2*a* shows a schematic block diagram of a known single-stage driver device with input storage capacitor.
Figure 2B:
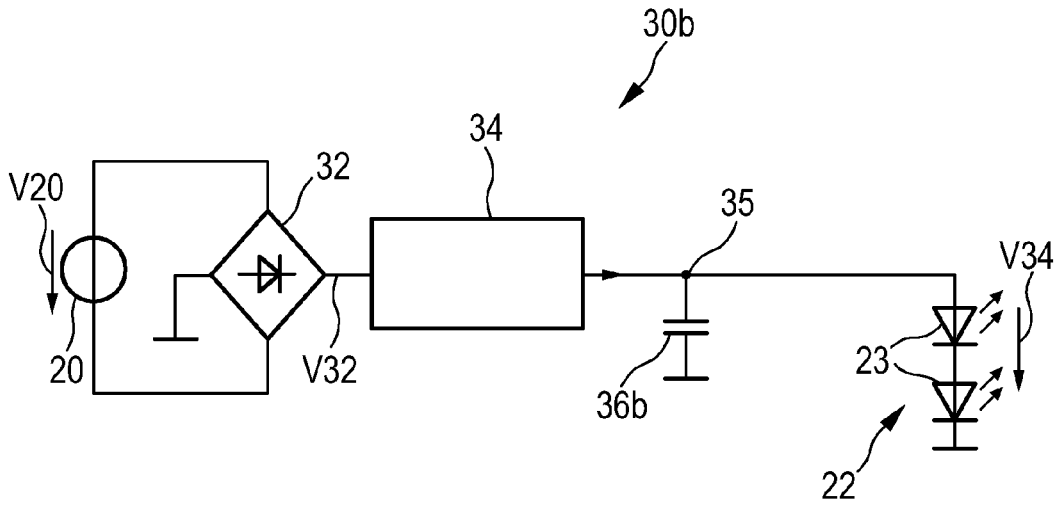
FIG. 2*b* shows a schematic block diagram of a known single-stage driver device with output storage capacitor.

Embodiments of known single-stage driver devices 30*a*, 30*b* are schematically shown in FIG. 2*a* and FIG. 2*b*, respectively. Said driver device 30 comprises a rectifier unit 32 (that may be identical to the rectifier unit 12 of the two-stage driver device 10 shown in FIG. 1) and a conversion unit 34 (e.g. flyback converter for the embodiment shown in FIG. 2*b* or a buck converter for the embodiment shown in FIG. 2*a*) coupled to the output of the rectifier unit 32. Further, in the embodiment shown in FIG. 2*a* a charge capacitor 36*a* (representing a low frequency input storage capacitor) is coupled to the node 33 between said rectifier unit 32 and said conversion unit 34. In the embodiment shown in FIG. 2*b*, the charge capacitor 36*b* (representing a low frequency output storage capacitor) is coupled to the node 35 between said conversion unit 34 and the load 22. The rectifier unit rectifies an AC input voltage V20 provided, e.g., from an external mains voltage supply (also called power supply) 20, into a rectified voltage V32. The rectified voltage V32 is converted into the desired DC drive voltage V34 for driving the load 22.

The storage capacitors 18 (in FIG. 1) and 36*a*, 36*b* (in FIGS. 2*a*, 2*b*) are mainly provided to filter out the low frequency component of the rectified voltage V12 in order to allow for a constant current into the load. Such capacitors are therefore large, particularly when placed in parallel with the load and when such a load is an LED.

Driver devices as shown in FIGS. 1 and 2 are, for instance, described in Robert Erickson and Michael Madigan, "Design of a simple high-power-factor rectifier based on the flyback converter", IEEE Proceedings of the Applied Power Electronics Conferences and Expositions, 1990, pp. 792-801.

Although most of those single-stage driver devices 30*a, b* feature a lower number of hardware components compared to two-stage driver devices as exemplarily shown in FIG. 1, they generally cannot offer a high power factor and a barely perceptible flicker simultaneously due to limitations in the size of the charge capacitor, which must filter out the low frequency component of the AC input voltage. In addition, single-stage driver devices may critically compromise the size, the lifetime and the maximum temperature operation of the load (e.g. a lamp) due to the use of large storage capacitors used to mitigate perceptible flicker.

Figure 3A:
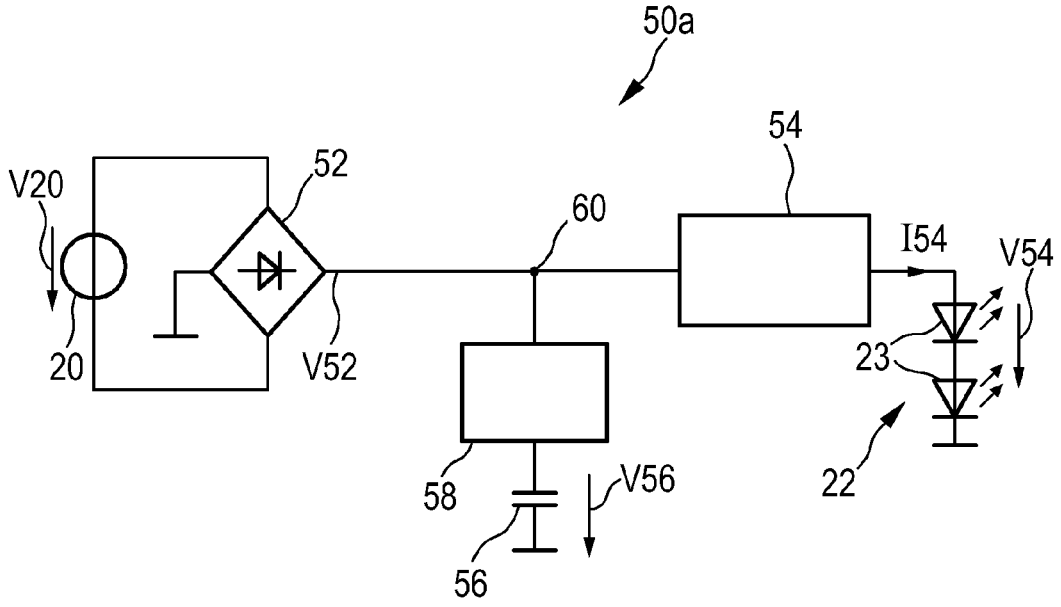
FIG. 3*a* shows a schematic block diagram of a first embodiment of a driver device according to the present invention.

A first embodiment of a driver device 50*a* according to the present invention is schematically shown in FIG. 3*a*. It comprises power input unit 52 (e.g. comprising a conventional rectifier, such as a full-bridge or half-bridge rectifier as explained above, for rectifying a supplied AC input voltage V20, or alternatively comprising just power input terminals in case an already rectified input voltage is provided as input) for providing a periodic supply voltage V52, a power conversion unit 54 (e.g. a conventional buck converter) for converting said supply voltage V52 to a load current 154 for powering the load 22 (load voltage V54), a charge capacitor 56 for storing a charge and powering the load 22 when little or no energy is drawn from the mains voltage supply 20 (e.g. in case the magnitude of input voltage/mains voltage V20 falls below a certain switching threshold), and a control unit 58 (coupled to the node 60) for controlling the charging of said charge capacitor 56 by said supply voltage V52 to a capacitor voltage V56 that is substantially higher than the peak voltage of said supply voltage V52 and for powering the load 22.

Figure 3B:
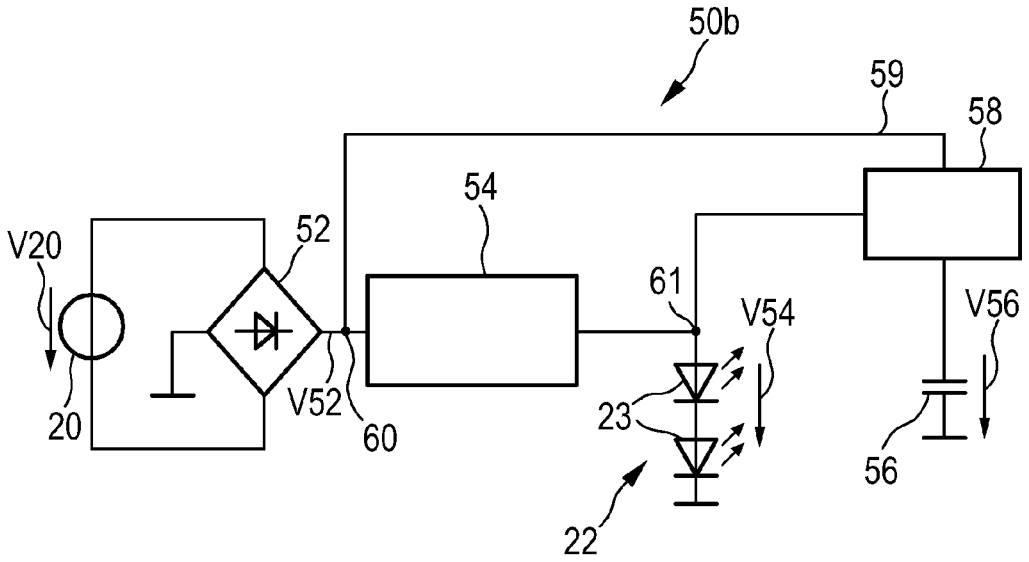
FIG. 3*b* shows a schematic block diagram of a second embodiment of a driver device according to the present invention.

A second embodiment of a driver device 50*b* according to the present invention is schematically shown in FIG. 3*b*. Compared to the first embodiment of the driver device 50*a*, the control unit 58 and the charge capacitor 56 are coupled to the output 61 of the power conversion unit 54. Further, a charging loop 59 coupled to the node 60 between the power input unit 52 and the power conversion unit 54 is provided.

Figure 3C:
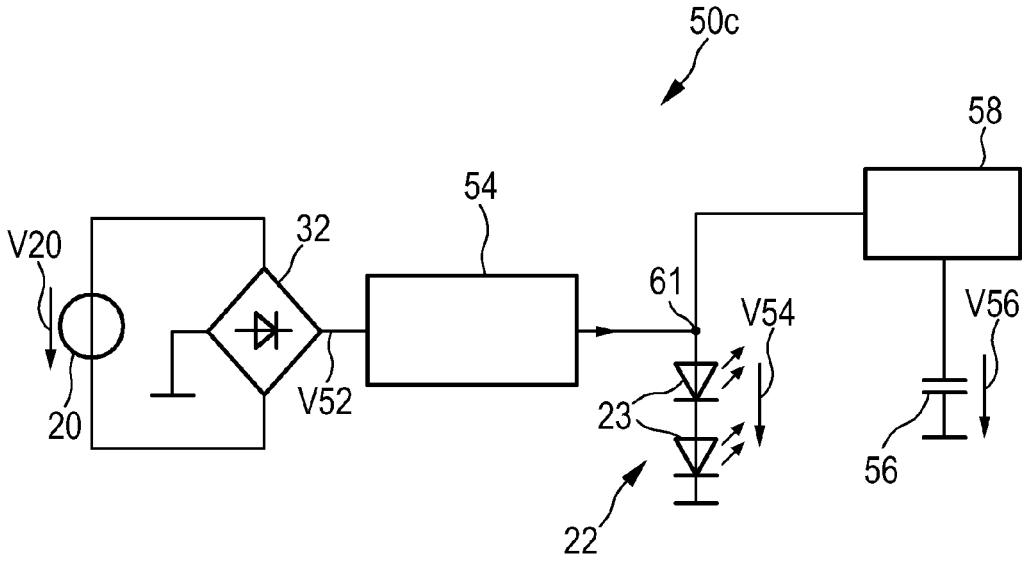
FIG. 3*c* shows a schematic block diagram of a third embodiment of a driver device according to the present invention.

A third embodiment of a driver device 50*c* according to the present invention is schematically shown in FIG. 3*c*. This embodiment is substantially identical to the embodiment of the driver device 50*b*, i.e. the control unit 58 and the charge capacitor 56 are coupled to the output 61 of the power conversion unit 54, but it does not comprise the control loop 59. In this embodiment, the control unit 58 may comprise a conventional bidirectional boost or buck-boost converter.

As shown in the embodiments depicted in FIGS. 3*a*, 3*b*, 3*c*, the control unit 58 according to the present invention can be easily incorporated in single-stage drivers that may perform the step-down or step-up conversion functions. The charge capacitor 56 provides the required energy to the power conversion unit 54 so as to maintain a constant flow of energy to the load 22 during the periods where little or no energy is delivered from the mains voltage supply 20, e.g. when the magnitude of the input voltage V20 is lower than the load voltage V54 in case power conversion unit 54 includes a conventional step-down converter (in case of a step down conversion the input voltage must be higher than or equal to the output or load voltage in order for the conversion energy to occur, whereas in case of a boost converter said switching threshold can be much lower than the output voltage).

Compared to known driver devices 10, 30 shown in FIGS. 1 and 2, the driver device according to the present invention incorporates the control unit 58 that can controllably charge the charge capacitor 56 to a certain high voltage level, so that the charge capacitance required to avoid perceptible flicker can be minimized, thereby improving the power factor, size and lifetime. Said control unit 58 therefore boosts the capacitor voltage at a given time and partly controls the transfer of energy from it to the load 22. Preferably, the control unit 58 only operates during brief periods of the mains cycle, and thus conversion efficiency can be high. If properly controlled, the control unit 58 does not require large storage elements and therefore it can be small. Thus, the proposed solution offers a high power factor, no perceptible flicker, a high efficiency, a reduced size and a very low filter capacitance of the charge capacitor 56 (and hence reduced size and long lifetime).

Figure 4A:
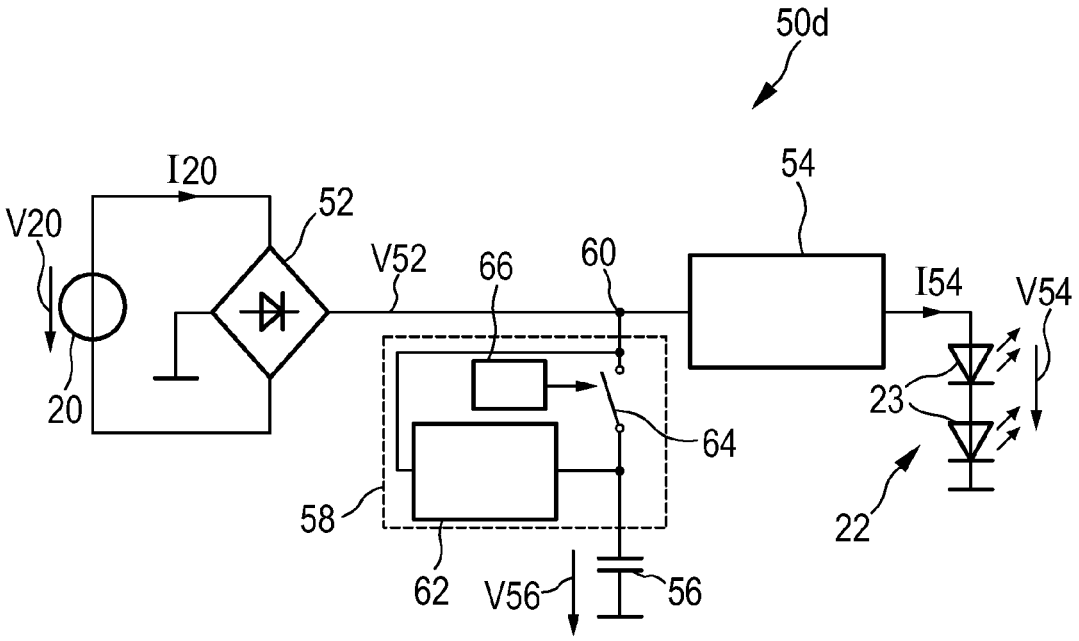
FIG. 4*a* shows a detailed schematic block diagram of the first embodiment of a driver device according to the present invention.

FIG. 4*a* schematically illustrates an embodiment of a driver device 50*d* of the present invention, showing a more detailed implementation of the driver device 50*a* shown in FIG. 3*a*. Same elements are referenced by the same reference numerals as used in the first embodiment illustrated in FIG. 3. In this embodiment of the driver device 50*d*, the control unit 58 is coupled between said charge capacitor 56 and the node 60 between said power input unit 52 and said power conversion unit 54.

In this embodiment the charge capacitor 56 is connected between the power input unit 52 and the power conversion unit 54. The control unit 58 is coupled in series to the charge capacitor 56. The control unit 58 comprises a charging control unit 62 (e.g. a conventional boost converter) coupled to said power input unit 52 for controlling the charging of said charge capacitor 56 by said supply voltage V52 to a capacitor voltage V56 that can be substantially higher than the peak voltage of said supply voltage V52. Said charging control unit 62 may, for instance, comprise a boost converter. Further, the control unit 58 comprises a switch 64, in particular a low-frequency (LF) switch 64, coupled in parallel with said charging control unit 62 for connecting said charge capacitor 56 to and disconnecting it from the node 60 for powering the load 22 through the power conversion unit 54, and a switch control unit 66 for controlling said switch 64.

Figure 4B:
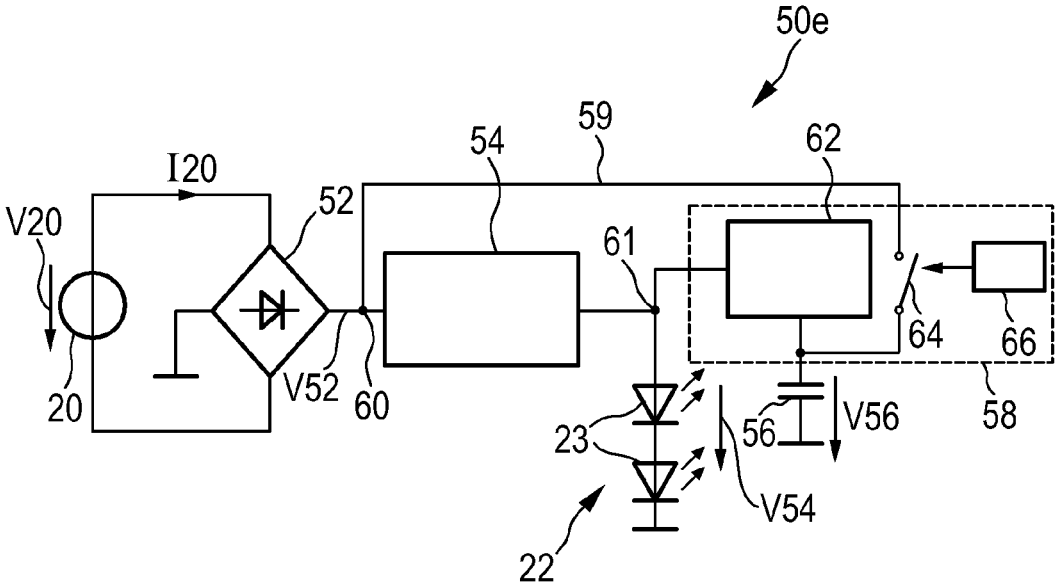
FIG. 4*b* shows a detailed schematic block diagram of the second embodiment of a driver device according to the present invention.

FIG. 4*b* schematically illustrates an embodiment of a driver device 50*e* of the present invention showing a more detailed implementation of the driver device 50*b* shown in FIG. 3*b*. In this embodiment, the charging control unit 62 is coupled between the output 61 of the power conversion unit 54 and the charge capacitor 56. When the switch 64 is open, as controlled by the switch control unit 66, the charge capacitor 56 is charged through the output voltage of the power conversion unit 54. When the switch 64 is closed, the charge capacitor 56 provides its power through the charging loop 59 to the node 60 for providing power to the power conversion unit 54.

According to the embodiments shown in FIGS. 3*b* and 4*b*, the power to charge the charge capacitor is drawn from the power conversion unit instead of directly from the mains/the input power supply as is the case in the embodiments shown in FIGS. 3*a*, 4*a*. The advantage of these embodiments is that the charge control unit 62 can operate more efficiently in a wider range of the mains cycle due to a more moderate conversion ratio compared to the charge control unit 62 of the embodiments shown in FIGS. 3*a*, 4*a*.

The embodiment shown in FIG. 3*c* avoids the use of a switch and its switching control completely by using a bidirectional charge control unit as control unit 58. Such a bidirectional charge control unit can transfer energy from the power conversion unit 54 to the charge capacitor 56 and from the charge capacitor 56 to the load 22. This can be achieved by, for instance, a bidirectional boost or buck-boost. The operation would then be equal to the operation of the other embodiments except that no (LF) switch is required. The advantages of the embodiment with respect to the other embodiments are that the use of a LF switch and its associated control is avoided. Further, the bidirectional charge control unit may comprise a buck-boost converter, and consequently, the utilization of the capacitance energy can be maximized since the capacitor voltage can now drop below the load voltage V54. This can result in an even smaller charge capacitor and hence improved lifetime, power factor and size.

Figure 5:
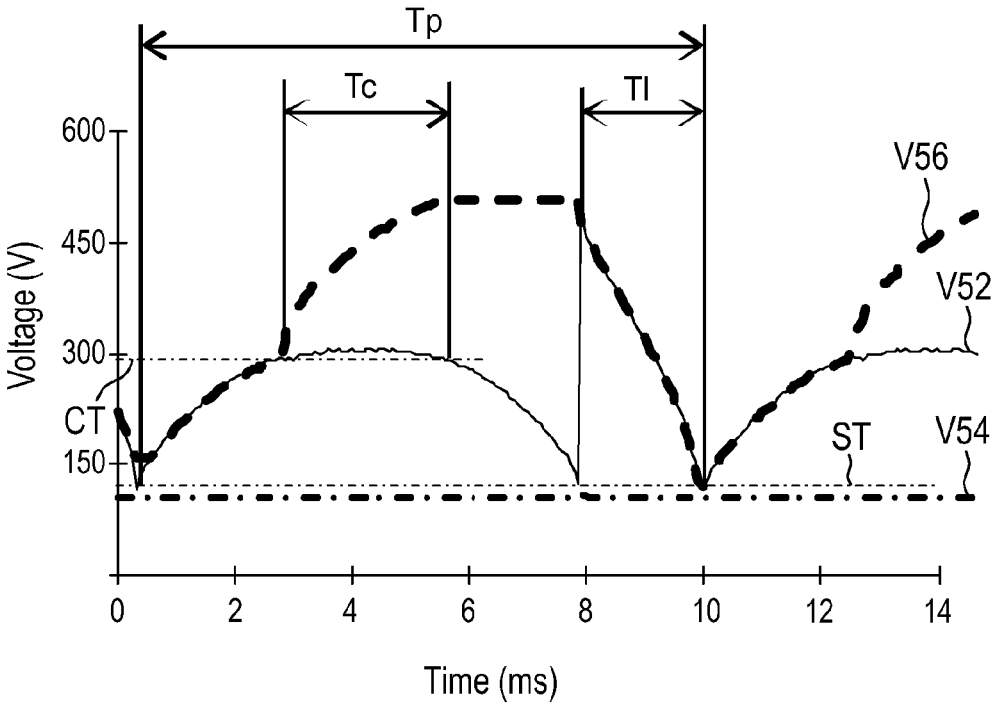
FIG. 5 shows a diagram illustrating voltage waveforms of the embodiment of the driver device shown in FIG. 4*a*.
Figure 6:
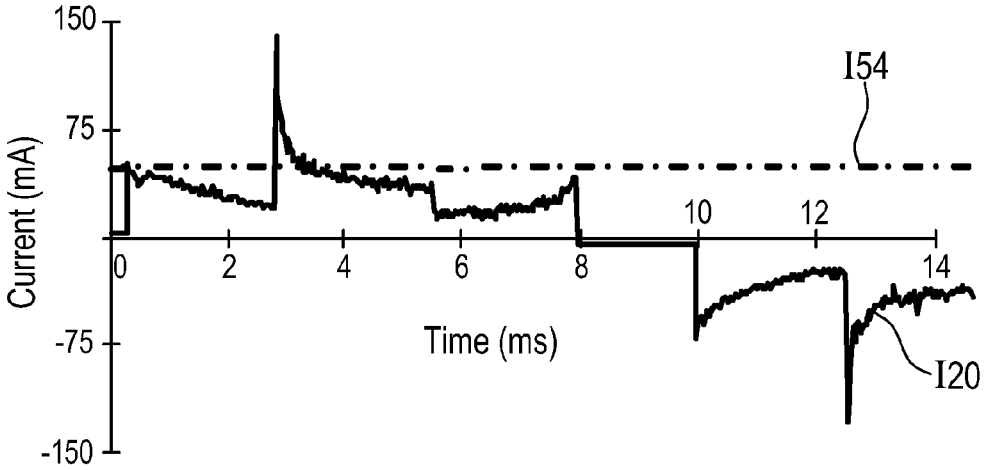
FIG. 6 shows a diagram illustrating current waveforms of the embodiment of the driver device shown in FIG. 4*a*.

The operation of the driver device 50*d* is illustrated in the simulated waveforms depicted in FIGS. 5 and 6 for the case where power conversion unit 54 is a synchronous buck converter. The switch 64 remains off as long as the magnitude of input voltage V20 (i.e. the mains voltage) is higher than the output voltage V54 of the converter 54. As long as this condition is met, the input voltage V52 of the converter 54 equals the magnitude of the mains voltage V20.

The charging control unit 62 is operable such that the voltage V56 across charge capacitor 56 must be higher than or equal to the rectified mains voltage V52. The boost functionality of the charging control unit 62 is only operational for a short period Tc of time relative to the rectified mains period Tp. In the illustrated example, the voltage V56 across the charge capacitor 56 is boosted to about 500V during the time Tc where the (European) mains rectified voltage V52 is higher than 290V. Once the charge capacitor 56 has been charged to that level, the voltage V56 across the charge capacitor 56 remains constant until the mains rectified voltage V52 approaches the output voltage V54. At that time, the switch 64 turns on (closes) and the voltage V56 across the charge capacitor 56 is impressed at the input of the power conversion unit 54. At this moment, the period T1 (also called valley filling period) starts, during which the charge from the charge capacitor 56 is transferred to the power conversion unit 54 and the load 22. The required capacitance to fill in the gap and ensure constant power delivery to the load 22 depends on the output power and the maximum boost voltage across the charge capacitor 56. The capacitor size is designed such that, in the worst-case condition (i.e. heavy load), the magnitude of the mains voltage V20 reaches a value higher than V56 slightly before the voltage V56 drops below voltage V54. At this time, the switch 64 turns off and hence the T1 period ends.

In the given example, the following exemplary values may be provided for the used elements. The charge capacitor 56 can be as low as 120 nF while maintaining a constant output power of 5 W. The charging control circuit may comprise a conventional boost converter employing a coil of just 50 μH operating at 300 kHz. The front-end converter 54 analysed to drive the LED load 22 is a synchronous rectifier operating in quasi-square wave (i.e. ZVS), thus allowing both the miniaturisation of the filter components and high efficiency. The output filter of this converter may comprise a 200 μH coil and 400 nF (100V) capacitor. The efficiency of the converter 54 and the charging control unit 58 is estimated to be 90%. The mains current 120 shown in FIG. 6 corresponds to a power factor of 90%.

In an embodiment, the switch control unit controls the switch to connect said charge capacitor to said power conversion unit for powering said load when said supply voltage V52 drops below a switching threshold ST and to disconnect said charge capacitor from said power conversion unit when the capacitor voltage V56 drops below said switching threshold ST. The switching threshold ST corresponds, for instance, to the load voltage V54 across the load or a voltage slightly higher (e.g. 1-10% higher) than the load voltage V54 across the load (as shown in FIG. 5). The switching threshold may, however, also be a predetermined fixed value.

Preferably, the charging control unit 62 is able to perform active control, in particular for controlling the timing, in particular the start time, stop time and duration, of the charging of said charge capacitor 56. Further, the charging control unit 62 is preferably adapted for controlling the timing of the charging of said charge capacitor 56 such that the charge capacitor 56 is charged during a charging period where the supply voltage V52 is above a charging threshold CT. Hence, in this embodiment, only during the peak time Tc of the supply voltage V52, the charge capacitor 56 is charged. Generally, the speed, form and/or degree of the charging of said charge capacitor 56 may be controlled by the control unit 62.

The proposed invention thus offers a solution for a driver device and driving method for driving a load, which solution enables perceptible flicker to be eliminated by use of a very low filter capacitance, i.e. a very low capacitance of the charge capacitor. Hence, the need for using large capacitors that negatively impact both the power density of the driver and the lifetime of the load, in particular a light assembly comprising an LED unit of one or more LEDs, is effectively avoided.

As mentioned, the present invention is preferably adapted for driving a light assembly, but can generally also be used for driving other kinds of loads, in particular any DC load such as a DC motor, organic LEDs and other electronic loads that need to be driven appropriately.

As a direct consequence of the low input filter capacitance, the power factor of the driver device according to the present invention can be substantially enhanced. Furthermore, the proposed solution can feature both reduced space and high conversion efficiency, thus overcoming the aforementioned limitations of the known driver devices, in particular most existing preconditioner-based driver devices. The driver device and method according to the present invention thus combine the advantages of the known single-stage and two-stage solutions.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope thereof.

The invention claimed is:

1. A driver device for driving an LED unit comprising one or more LEDs, said driver device comprising:

a power input unit configured to receive an input voltage from an external power supply and for providing a rectified supply voltage;

a power conversion unit configured to convert said supply voltage to a load current for powering a load;

a charge capacitor configured to store a charge and power the load when insufficient energy for powering the load and/or the power conversion unit is drawn from said external power supply at a given time; and a control unit coupled in series to said charge capacitor, and to the output of the power conversion unit, said control unit configured to control the charging and discharging of said charge capacitor, the control unit comprising:

a charging control unit configured to control the charging of said charge capacitor by said supply voltage to a capacitor voltage substantially higher than the peak voltage of said supply voltage, the charging control unit comprising a boost converter, wherein the charging control unit is coupled to said output of the power conversion unit, said control unit comprising:

a switch configured to switchably connect between said charge capacitor and a node between said power input unit and said power conversion unit for providing energy stored in said charge capacitor to the power conversion unit; and a switch control unit configured to control said switch.

2. The driver device as claimed in claim 1, wherein said control unit is connected to the output of the power conversion unit, said control unit comprising a bidirectional charging control unit for charging the charge capacitor by a load voltage across said load to the capacitor voltage substantially higher than the load voltage.

3. The driver device as claimed in claim 1, further comprising a power supply unit and a rectifier unit configured to rectify a provided AC input voltage into a rectified periodic supply voltage.

4. A method for driving an LED unit comprising one or more LEDs, the method comprising:

receiving an input voltage from an external power supply;

providing, with a power input unit, a rectified supply voltage by rectifying the input voltage;

converting, with a power conversion unit, said supply voltage to a load current for powering a load;

storing, in a charge storage capacitor, a charge and powering the load when insufficient energy for powering the load and/or the power conversion unit is drawn from said external power supply at a given time; and controlling, with a control unit, the charging and discharging of said charge capacitor, the charge unit comprising:

a charging control unit for controlling the charging of said charge capacitor by said supply voltage to a capacitor voltage substantially higher than the peak voltage of said supply voltage, the charging control unit comprising a boost converter said control unit is coupled between said charge capacitor and a node between said power input unit and said power conversion unit, said control unit comprising:

a switch coupled in parallel with said charging control unit and configured to switchably connect said charge capacitor to the node between said power input unit and said power conversion unit for providing energy stored in said charge capacitor to the power conversion unit; and a switch control unit configured to control said switch.

5. A light apparatus comprising:

a light assembly comprising one or more light units, in particular an LED unit comprising one or more LEDs; and a driver device configured to drive said light assembly as claimed in claim 1.

6. The method of claim 4, wherein:

said control unit is connected to the output of the power conversion unit, and the charging control unit is coupled to said output of the power conversion unit, said control unit comprising:

a switch configured to switchably connect between said charge capacitor and a node between said power input unit and said power conversion unit for providing energy stored in said charge capacitor to the power conversion unit; and a switch control unit configured to control said switch.

7. The method of claim 4, wherein said switch control unit is adapted to control said switch to connect said charge capacitor to said power conversion unit configured to power said load when said supply voltage drops below a switching threshold and to disconnect said charge capacitor from said power conversion unit when the capacitor voltage drops below said switching threshold.

8. The method of claim 7, wherein said switching threshold corresponds to the load voltage across the load or a voltage slightly higher than the load voltage.

9. The method of claim 4, wherein said control unit is connected to the output of the power conversion unit, said control unit comprising a bidirectional charging control unit configured to charge the charge capacitor by a load voltage across said load to the capacitor voltage substantially higher than the load voltage.

10. The method of claim 4, wherein said charging control unit is adapted to control the timing, in particular the start time, stop time and duration, of the charging of said charge capacitor.

11. The method of claim 4, wherein said charging control unit is adapted to control the timing of the charging of said charge capacitor such that the charge capacitor is charged during a charging period where the supply voltage is above a charging threshold.

12. The method of claim 4, wherein said charging control unit is adapted to control the speed, form and/or degree of the charging of said charge capacitor.

13. A driver device for driving an LED unit comprising one or more LEDs, said driver device comprising:

a power input unit configured to receive an input voltage from an external power supply and for providing a rectified supply voltage;

a power conversion unit configured to convert said supply voltage to a load current for powering a load;

a charge capacitor configured to store a charge and power the load when insufficient energy for powering the load and/or the power conversion unit is drawn from said external power supply at a given time; and a control unit coupled in series to said charge capacitor and between said charge capacitor and a node between said power input unit and said power conversion unit, said control unit configured to control the charging and discharging of said charge capacitor, the control unit comprising:

a charging control unit configured to control the charging of said charge capacitor by said supply voltage to a capacitor voltage substantially higher than the peak voltage of said supply voltage, the charge control unit comprising: a boost converter, and a switch coupled in parallel with said charging control unit configured to switchably connect said charge capacitor to the node between said power input unit and said power conversion unit for providing energy stored in said charge capacitor to the power conversion unit; and a switch control unit configured to control said switch.

14. The driver device as claimed in claim 13, wherein said switch control unit is adapted to control said switch to connect said charge capacitor to said power conversion unit configured to power said load when said supply voltage drops below a switching threshold and to disconnect said charge capacitor from said power conversion unit when the capacitor voltage drops below said switching threshold.

15. The driver device as claimed in claim 14, wherein said switching threshold corresponds to the load voltage across the load or a voltage slightly higher than the load voltage.

16. The driver device as claimed in claim 13, wherein said charging control unit is adapted to control the timing, in particular the start time, stop time and duration, of the charging of said charge capacitor.

17. The driver device as claimed in claim 13, wherein said charging control unit is adapted to control the timing of the charging of said charge capacitor such that the charge capacitor is charged during a charging period where the supply voltage is above a charging threshold.

18. The driver device as claimed in claim 13, wherein said charging control unit is adapted to control the speed, form and/or degree of the charging of said charge capacitor.

* * * * *